US010829922B2

(12) United States Patent
Brill et al.

(10) Patent No.: US 10,829,922 B2
(45) Date of Patent: Nov. 10, 2020

(54) LINEAR DRAIN SYSTEM INCLUDING DRAIN CHANNEL AND SUPPORT BRACKET ASSEMBLY

(71) Applicant: INFINITY DRAIN LTD., Amityville, NY (US)

(72) Inventors: Jonathan Brill, Amityville, NY (US); Alan Trink, Amityville, NY (US); Bhasnarine Ramkarran, Amityville, NY (US)

(73) Assignee: INFINITY DRAIN LTD., Amityville, NY (US)

( * ) Notice: Subject to any disclaimer, the term of this patent is extended or adjusted under 35 U.S.C. 154(b) by 50 days.

(21) Appl. No.: 16/299,546

(22) Filed: Mar. 12, 2019

(65) Prior Publication Data

US 2019/0211541 A1 Jul. 11, 2019

Related U.S. Application Data

(63) Continuation-in-part of application No. 15/994,609, filed on May 31, 2018.

(60) Provisional application No. 62/571,042, filed on Oct. 11, 2017.

(51) Int. Cl.
*E03F 5/04* (2006.01)

(52) U.S. Cl.
CPC ..... *E03F 5/0408* (2013.01)

(58) Field of Classification Search
CPC ..... E03F 5/0408; E03F 5/0407; E03F 5/04
USPC ..... 4/679, 680
See application file for complete search history.

(56) References Cited

U.S. PATENT DOCUMENTS

| | | | | |
|---|---|---|---|---|
| 9,334,638 | B1 * | 5/2016 | Kirby | A47K 3/40 |
| 2010/0162481 | A1 * | 7/2010 | Erlebach | E03F 5/04 4/613 |
| 2011/0162137 | A1 * | 7/2011 | Kik, Sr. | E03F 3/046 4/613 |
| 2016/0160488 | A1 * | 6/2016 | Nemec | E03F 5/0408 137/343 |
| 2018/0038091 | A1 * | 2/2018 | Ismert | E03F 5/0401 |
| 2019/0106874 | A1 * | 4/2019 | Brill | E03F 5/0408 |
| 2019/0169831 | A1 * | 6/2019 | Wadaga | E03F 5/0408 |

* cited by examiner

*Primary Examiner* — Huyen D Le
(74) *Attorney, Agent, or Firm* — F. Chau & Associates, LLC

(57) ABSTRACT

A linear drain system includes a drain channel and a support bracket assembly. The drain channel includes an upper surface, a lower surface, and a plurality of side surfaces connecting the upper surface and the lower surface. The drain channel further includes a drain hole disposed in the lower surface, and an L-shaped recess formed on an underside of the drain channel by the upper surface, the lower surface, and the side surfaces. The support bracket assembly is shaped and dimensioned to fit in the L-shaped recess. When the support bracket assembly is disposed in the L-shaped recess, a bottom portion of the upper surface of the drain channel contacts an upper surface of the support bracket assembly, and outer portions of the side surfaces of the drain channel contact inner side surfaces of the support bracket assembly.

20 Claims, 7 Drawing Sheets

LINEAR DRAIN SYSTEM INCLUDING DRAIN CHANNEL AND SUPPORT BRACKET ASSEMBLY

CROSS-REFERENCE TO RELATED APPLICATIONS

This application is a continuation-in-part application of U.S. application Ser. No. 15/994,609 filed on May 31, 2018, which claims the benefit of Provisional Application Ser. No. 62/571,042 filed on Oct. 11, 2017, the disclosures of which are incorporated by reference herein in their entireties.

BACKGROUND

1. Technical Field

Exemplary embodiments of the present invention relate to a linear drain system, and more particularly, a linear drain system including a drain channel and a support bracket assembly.

2. Discussion of Related Art

A linear drain is a type of floor drain having a channel-shaped body. A linear drain may be positioned, for example, along a wall or along the threshold of a shower enclosure. Linear drains have become an important element in the overall design of bathrooms and wet rooms, as well as in outdoor application.

A linear drain is typically installed in a floor by creating a mortar bed (also referred to as a cement bed or a mud bed) that extends the length of a drain channel of the linear drain, and by backfilling the underside of the drain channel. The mortar bed is used to level the linear drain, and to provide support for the linear drain.

SUMMARY

According to an exemplary embodiment of the present application, a linear drain system includes a drain channel and a support bracket assembly. The drain channel includes an upper surface, a lower surface, and a plurality of side surfaces connecting the upper surface and the lower surface, as well as a drain hole disposed in the lower surface, and an L-shaped recess formed on an underside of the drain channel by the upper surface, the lower surface, and the side surfaces. The support bracket assembly is shaped and dimensioned to fit in the L-shaped recess. When the support bracket assembly is disposed in the L-shaped recess, a bottom portion of the upper surface of the drain channel contacts an upper surface of the support bracket assembly, and outer portions of the side surfaces of the drain channel contact inner side surfaces of the support bracket assembly.

In an exemplary embodiment, the support bracket assembly entirely surrounds a perimeter of the drain channel in a location adjacent to the outer portions of the side surfaces of the drain channel and below the upper surface of the drain channel when the support bracket assembly is disposed in the L-shaped recess.

In an exemplary embodiment, the upper surface of the drain channel entirely covers the support bracket assembly in a top plan view when the support bracket assembly is disposed in the L-shaped recess.

In an exemplary embodiment, the support bracket assembly includes a plurality of reconnectable bracket portions configured to connect to one another and disconnect from one another.

In an exemplary embodiment, the reconnectable bracket portions include (i) an end support bracket portion shaped and dimensioned to fit in the L-shaped recess at an end region of the drain channel, (ii) an extrusion bracket portion shaped and dimensioned to fit in the L-shaped recess at a side region of the drain channel, and configured to connect to the end support bracket portion, and (iii) a middle support bracket portion shaped and dimensioned to fit in the L-shaped recess at the side region of the drain channel, and configured to connect the extrusion bracket portion to another extrusion bracket portion disposed in the side region of the drain channel.

In an exemplary embodiment, the drain channel includes a first side and a second side opposing each other, and a third side and a fourth side opposing each other and connected between the first and second sides. The first side and the second side have a first length, and the third side and the fourth side have a second length greater than the first length. The end region of the drain channel corresponds to one of the first and second sides, and the side region of the drain channel corresponds to one of the third and fourth sides.

In an exemplary embodiment, the end support bracket portion includes a first main body portion extending in a first direction, a first protrusion extending from the first main body portion in a second direction crossing the first direction, and a second protrusion extending from the first main body portion in the second direction. The extrusion bracket portion includes a first opening at a first end, and a second opening at a second end opposing the first end. The middle support bracket portion includes a second main body portion extending in a third direction, a third protrusion extending from a first end of the middle support bracket portion in the third direction, and a fourth protrusion extending from a second end of the middle support bracket portion in the third direction. The second end of the middle support bracket portion opposes the first end of the middle support bracket portion.

In an exemplary embodiment, a width of the first main body portion is about equal to a width of the upper surface of the drain channel in the end region, a width of the extrusion bracket portion is about equal to a width of the upper surface of the drain channel in the side region, and a width of the second main body portion is about equal to the width of the upper surface of the drain channel in the side region.

According to an exemplary embodiment of the present invention, a linear drain system includes a drain channel and a support bracket assembly. The drain channel includes (i) an upper surface including a plurality of inner edges and a plurality of outer edges extended from the inner edges, (ii) a lower surface including a drain hole and a plurality of outer edges, and (iii) a plurality of side surfaces connecting the outer edges of the lower surface to the inner edges of the upper surface. A well region is formed by inner portions of the side surfaces and by the lower surface, and an L-shaped recess is formed by outer portions of the side surfaces and by a bottom portion of the upper surface. The support bracket assembly is shaped and dimensioned to fit in the L-shaped recess. When the support bracket assembly is disposed in the L-shaped recess, the bottom portion of the upper surface of the drain channel contacts an upper surface of the support bracket assembly, and the outer portions of the side surfaces of the drain channel contact inner side surfaces of the support bracket assembly.

In an exemplary embodiment, the support bracket assembly entirely surrounds a perimeter of the drain channel in a location adjacent to the outer portions of the side surfaces of the drain channel and below the upper surface of the drain channel when the support bracket assembly is disposed in the L-shaped recess.

In an exemplary embodiment, the upper surface of the drain channel entirely covers the support bracket assembly in a top plan view when the support bracket assembly is disposed in the L-shaped recess.

In an exemplary embodiment, a distance between opposing outer edges of the upper surface of the drain channel is greater than a distance between opposing outer edges of the lower surface of the drain channel, and the distance between the opposing outer edges of the lower surface of the drain channel is about equal to a distance between opposing inner edges of the upper surface of the drain channel.

In an exemplary embodiment, the support bracket assembly includes a rectangular through hole, and when the support bracket assembly is disposed in the L-shaped recess, the well region is disposed in the through hole.

In an exemplary embodiment, the support bracket assembly includes a plurality of reconnectable bracket portions configured to connect to one another and disconnect from one another.

In an exemplary embodiment, the reconnectable bracket portions include (i) an end support bracket portion shaped and dimensioned to fit in the L-shaped recess at an end region of the drain channel, (ii) an extrusion bracket portion shaped and dimensioned to fit in the L-shaped recess at a side region of the drain channel, and configured to connect to the end support bracket portion, and (iii) a middle support bracket portion shaped and dimensioned to fit in the L-shaped recess at the side region of the drain channel, and configured to connect the extrusion bracket portion to another extrusion bracket portion disposed in the side region of the drain channel.

In an exemplary embodiment, the drain channel includes a first side and a second side opposing each other, and a third side and a fourth side opposing each other and connected between the first and second sides. The first side and the second side have a first length, and the third side and the fourth side have a second length greater than the first length. The end region of the drain channel corresponds to one of the first and second sides, and the side region of the drain channel corresponds to one of the third and fourth sides.

In an exemplary embodiment, the end support bracket portion includes a first main body portion extending in a first direction, a first protrusion extending from the first main body portion in a second direction crossing the first direction, and a second protrusion extending from the first main body portion in the second direction. The extrusion bracket portion includes a first opening at a first end, and a second opening at a second end opposing the first end. The middle support bracket portion includes a second main body portion extending in a third direction, a third protrusion extending from a first end of the middle support bracket portion in the third direction, and a fourth protrusion extending from a second end of the middle support bracket portion in the third direction. The second end of the middle support bracket portion opposes the first end of the middle support bracket portion.

In an exemplary embodiment, a width of the first main body portion is about equal to a width of the upper surface of the drain channel in the end region, a width of the extrusion bracket portion is about equal to a width of the upper surface of the drain channel in the side region, and a width of the second main body portion is about equal to the width of the upper surface of the drain channel in the side region.

In an exemplary embodiment, a height of the first main body portion, a height of the extrusion bracket portion, and a height of the second main body portion are about equal to one another.

In an exemplary embodiment, the reconnectable bracket portions include (i) a first end support bracket portion shaped and dimensioned to fit in the L-shaped recess at a first end region of the drain channel. The first end support bracket portion includes a first main body portion, a first protrusion extending from the first main body portion, and a second protrusion extending from the first main body portion. The reconnectable bracket portions further include (ii) a second end support bracket portion shaped and dimensioned to fit in the L-shaped recess at a second end region of the drain channel that opposes the first end region. The second end support bracket portion includes a second main body portion, a third protrusion extending from the second main body portion, and a fourth protrusion extending from the second main body portion. The reconnectable bracket portions further include (iii) a first middle support bracket portion shaped and dimensioned to fit in the L-shaped recess at a first side region of the drain channel. The first middle support bracket portion includes a third main body portion, a fifth protrusion extending from the third main body portion, and a sixth protrusion extending from the third main body portion. The reconnectable bracket portions further include (iv) a second middle support bracket portion shaped and dimensioned to fit in the L-shaped recess at a second side region of the drain channel that opposes the first side region. The second middle support bracket portion includes a fourth main body portion, a seventh protrusion extending from the fourth main body portion, and an eighth protrusion extending from the fourth main body portion. The reconnectable bracket portions further include (v) a first extrusion bracket portion shaped and dimensioned to fit in the L-shaped recess at the first side region of the drain channel. The first extrusion bracket portion includes a first opening at a first end of the first extrusion bracket portion, and a second opening at a second end of the first extrusion bracket portion. The first extrusion bracket portion is configured to connect to the first end support bracket portion via the first opening receiving the first protrusion, and the first extrusion bracket portion is configured to connect to the first middle support bracket portion via the second opening receiving the fifth protrusion. The reconnectable bracket portions further include (vi) a second extrusion bracket portion shaped and dimensioned to fit in the L-shaped recess at the first side region of the drain channel. The second extrusion bracket portion includes a third opening at a first end of the first extrusion bracket portion, and a fourth opening at a second end of the second extrusion bracket portion. The second extrusion bracket portion is configured to connect to the second end support bracket portion via the third opening receiving the third protrusion, and the second extrusion bracket portion is configured to connect to the first middle support bracket portion via the fourth opening receiving the sixth protrusion. The reconnectable bracket portions further include (vii) a third extrusion bracket portion shaped and dimensioned to fit in the L-shaped recess at the second side region of the drain channel. The third extrusion bracket portion includes a fifth opening at a first end of the third extrusion bracket portion, and a sixth opening at a second end of the third extrusion bracket portion. The third extrusion bracket portion is configured to connect to the first end support bracket portion via the fifth opening receiving the second protrusion, and the third extrusion bracket portion is configured to connect to the second middle support bracket portion via the sixth opening receiving the seventh protrusion. The reconnectable bracket portions further include (viii) a fourth extrusion bracket portion shaped and dimensioned to fit in the L-shaped recess at the second side region of the drain channel. The fourth extrusion bracket portion includes a seventh opening at a first end of the fourth extrusion bracket portion, and an eighth opening at a second end of the fourth extrusion bracket portion. The fourth extrusion bracket portion is configured to connect to the second end support bracket portion via the eighth opening receiving the fourth protrusion, and the fourth extrusion bracket portion is configured to connect to the second middle support bracket portion via the seventh opening receiving the eighth protrusion.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Figure 1:
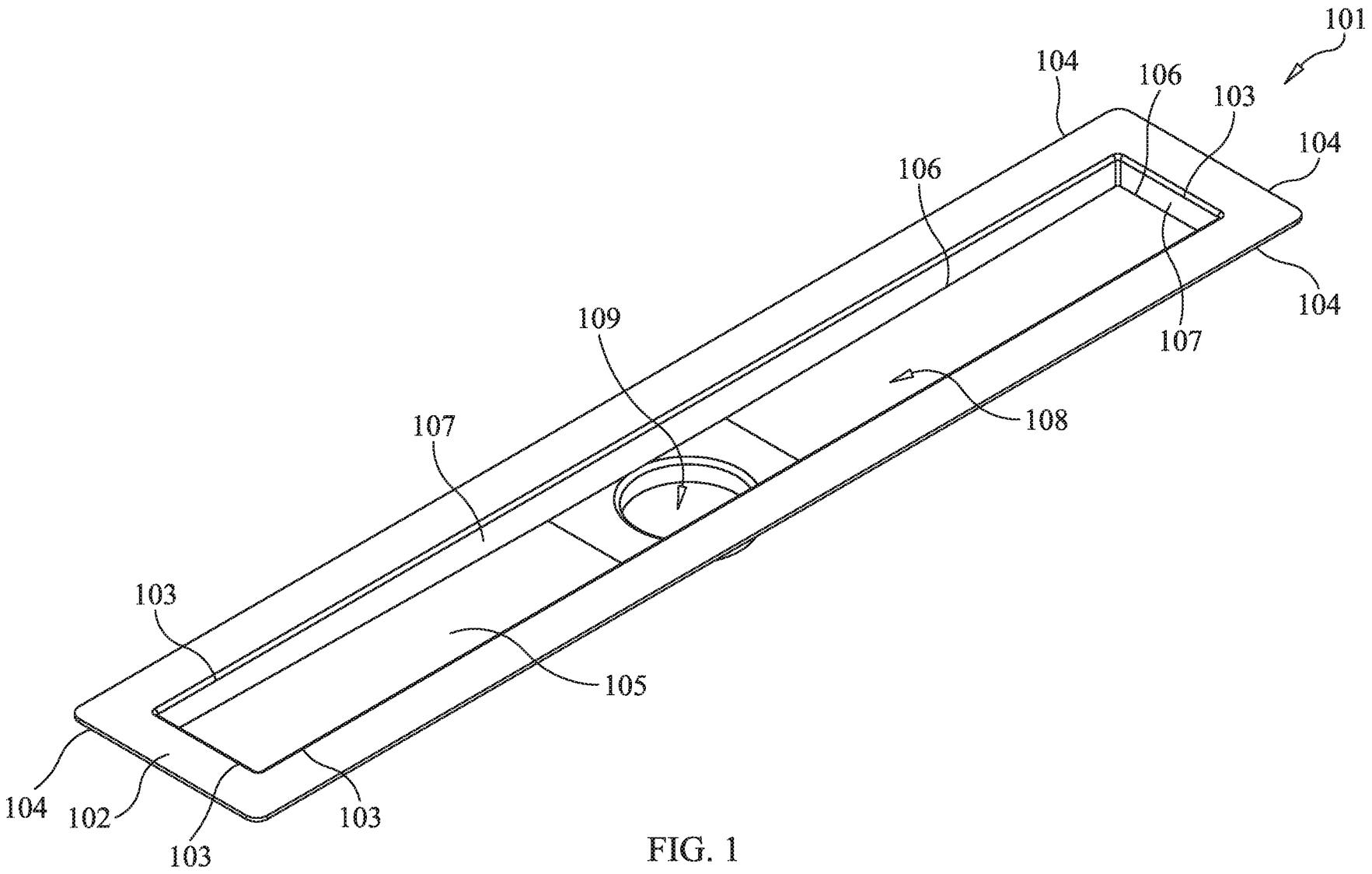
FIG. 1 is a top perspective view illustrating a drain channel of a linear drain system, according to an exemplary embodiment of the present invention.

Exemplary embodiments of the present invention will be described more fully hereinafter with reference to the accompanying drawings. Like reference numerals may refer to like elements throughout the accompanying drawings.

Hereinafter, spatially relative terms, such as "beneath", "below", "lower", "under", "above", "upper", etc., may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below.

It will be understood that the terms "first," "second," "third," etc. are used herein to distinguish one element from another, and the elements are not limited by these terms. Thus, a "first" element in an exemplary embodiment may be described as a "second" element in another exemplary embodiment. In addition, when two or more values (e.g., a length, a width, a height, a distance, etc.) are described as being substantially the same as or about equal to each other, it is to be understood that the elements or values are identical to each other, indistinguishable from each other, or distinguishable from each other but functionally the same as each other as would be understood by a person having ordinary skill in the art.

Linear drains are typically installed in a floor by creating a mortar bed (also referred to as a cement bed or a mud bed) that extends the length of a drain channel of the linear drain, and by backfilling the underside of the drain channel. The mortar bed is used to level the linear drain, and to provide support for the linear drain.

Exemplary embodiments of the present invention provide a linear drain system that includes a drain channel (also referred to as a linear drain, a channel drain, a line drain, a slot drain, or a strip drain) having an L-shaped recess formed on the underside thereof, and a corresponding support bracket assembly that is shaped and dimensioned to fit within the L-shaped recess, as described in further detail below. The support bracket assembly levels the drain channel, and provides support for the drain channel, without the need for creating and using a mortar bed. As a result, the efficiency and convenience with relation to installation of a linear drain are improved according to exemplary embodiments of the present invention.

According to exemplary embodiments of the present invention, a linear drain system 100 includes a drain channel 101 and a support bracket assembly 201. The drain channel 101 may be formed of, for example, stainless steel, and the support bracket assembly 201 may be formed of, for example, a plastic such as an acrylonitrile butadiene styrene (ABS) plastic. However, these materials are merely exemplary, and the materials used to form the drain channel 101 and the support bracket assembly 201 are not limited thereto.

Herein, the terms drain channel, linear drain, and trench drain, may be used interchangeably.

Figure 2:
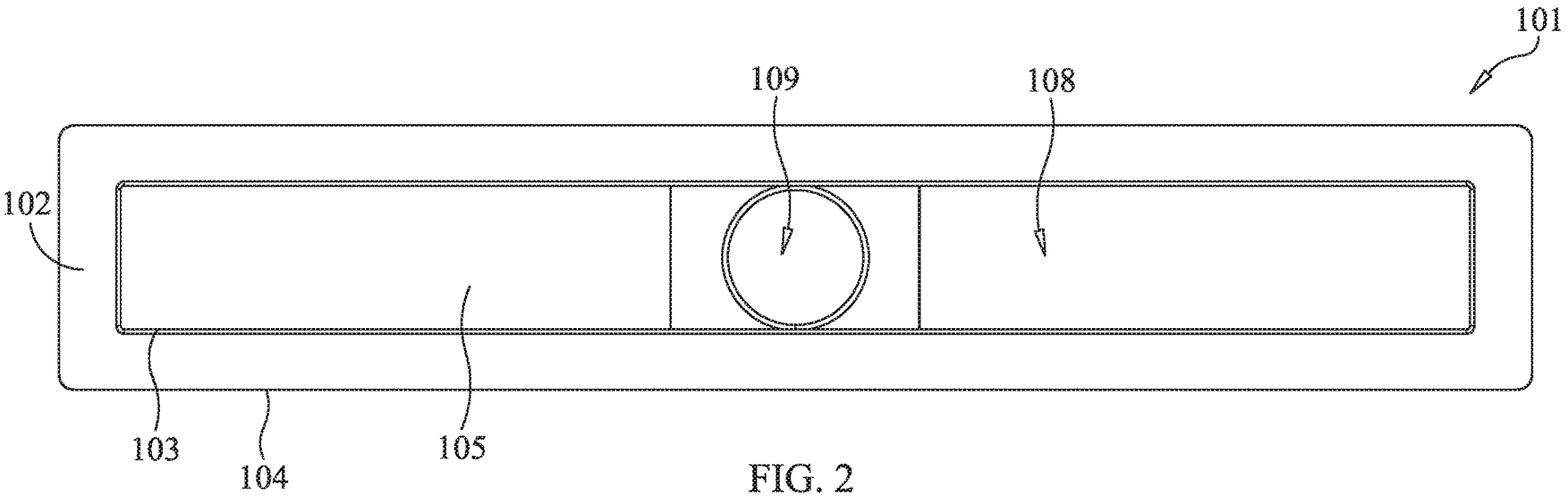
FIG. 2 is a top view illustrating a drain channel of a linear drain system, according to an exemplary embodiment of the present invention.
Figure 3:
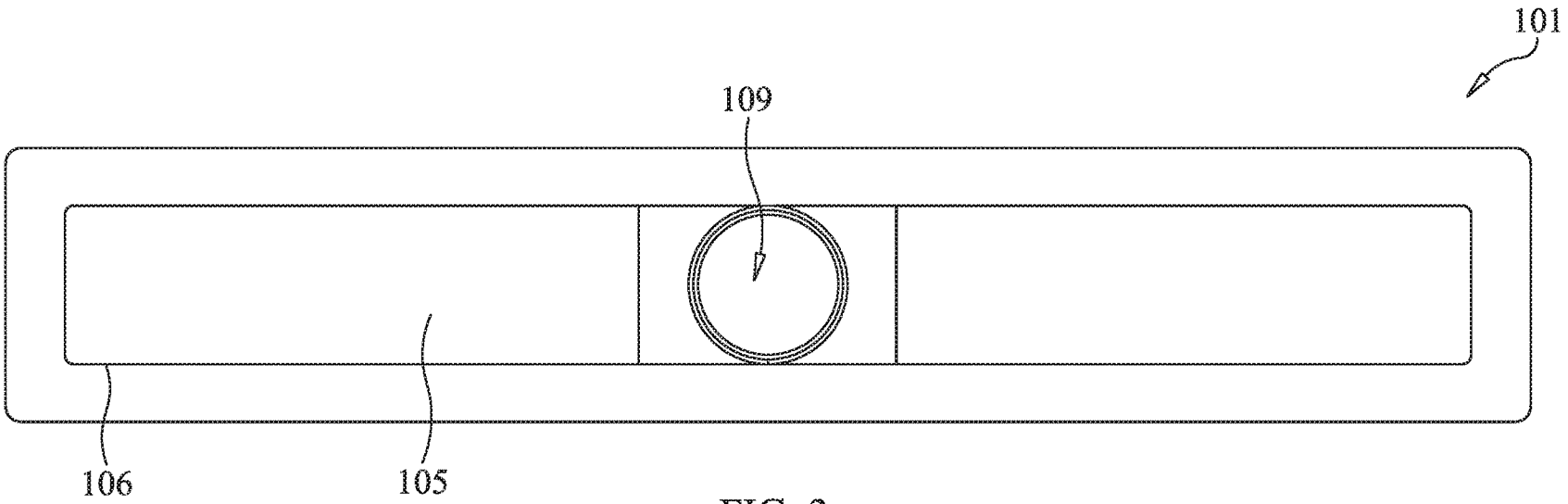
FIG. 3 is a bottom view illustrating a drain channel of a linear drain system, according to an exemplary embodiment of the present invention.

FIG. 1 is a top perspective view illustrating a drain channel of a linear drain system, according to an exemplary embodiment of the present invention. FIG. 2 is a top view illustrating a drain channel of a linear drain system, according to an exemplary embodiment of the present invention. FIG. 3 is a bottom view illustrating a drain channel of a linear drain system, according to an exemplary embodiment of the present invention.

Referring to FIGS. 1-3, the drain channel 101 includes an upper surface 102. The upper surface 102 includes a plurality of inner edges 103 and a plurality of outer edges 104 extended from the inner edges 103. The drain channel 101 further includes a lower surface 105. The lower surface 105 includes a drain hole 109 and a plurality of outer edges 106. The drain channel 101 further includes a plurality of side surfaces 107 that connect the outer edges 106 of the lower surface 105 to the inner edges 103 of the upper surface 102.

A well region 108 is formed by inner portions of the side surfaces 107 of the drain channel 101 and by the lower surface 105 of the drain channel 101. An L-shaped recess L is formed by outer portions of the side surfaces 107 of the drain channel 101 and by the upper surface 102 of the drain channel 101. For example, according to exemplary embodiments, a distance between opposing outer edges 104 of the upper surface 102 of the drain channel 101 is greater than a distance between opposing outer edges 106 of the lower surface 105 of the drain channel 101, and the distance between the opposing outer edges 106 of the lower surface 105 of the drain channel 101 is about equal to a distance between opposing inner edges 103 of the upper surface 102 of the drain channel 101. As a result, the well region 108 is formed by the inner portions of the side surfaces 107 of the drain channel 101 and by the lower surface 105 of the drain channel 101.

Figure 4:
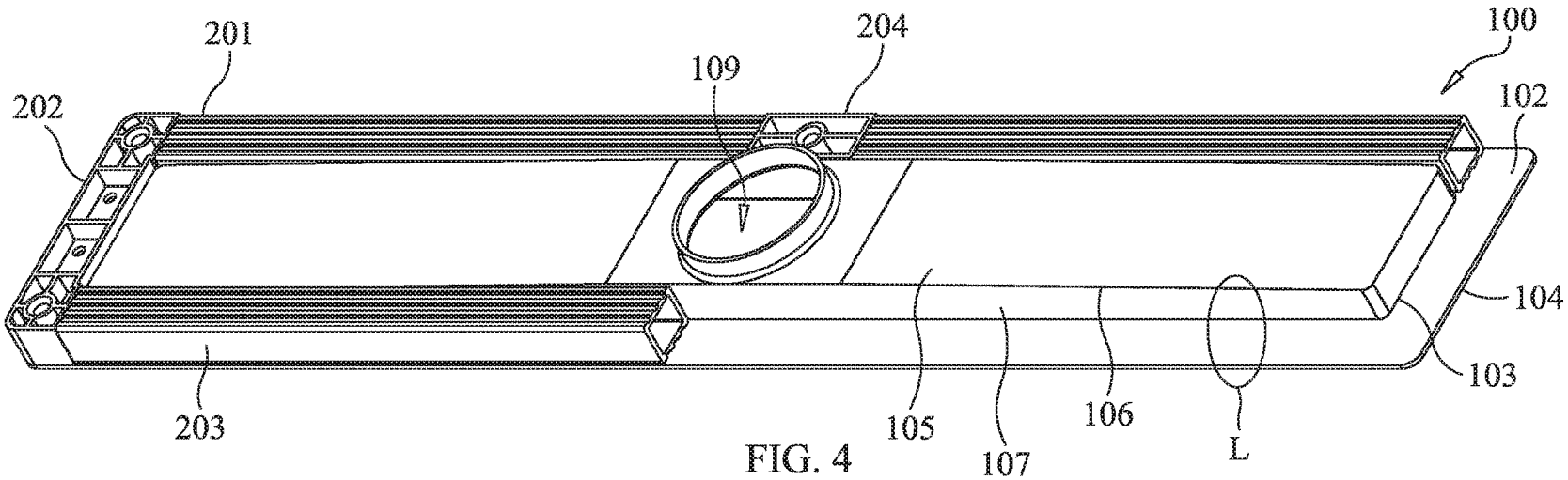
FIG. 4 is a bottom perspective view illustrating a drain channel and a support bracket assembly of a linear drain system, according to an exemplary embodiment of the present invention.
Figure 5:
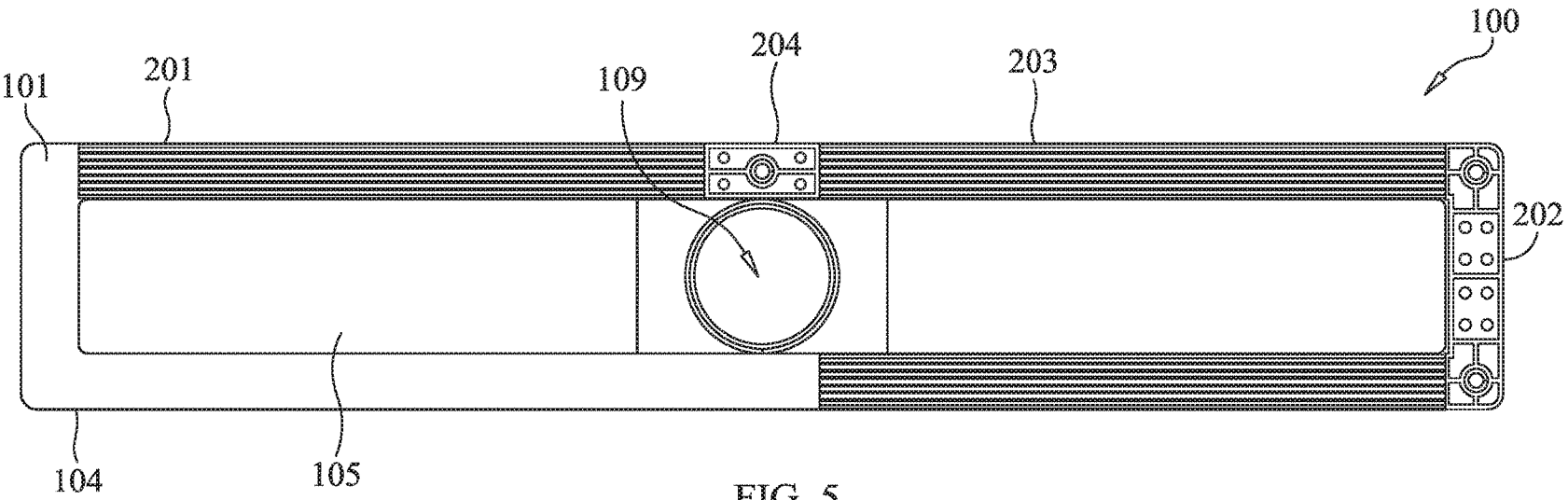
FIG. 5 is a bottom view illustrating a drain channel and a support bracket assembly of a linear drain system, according to an exemplary embodiment of the present invention.
Figure 6:
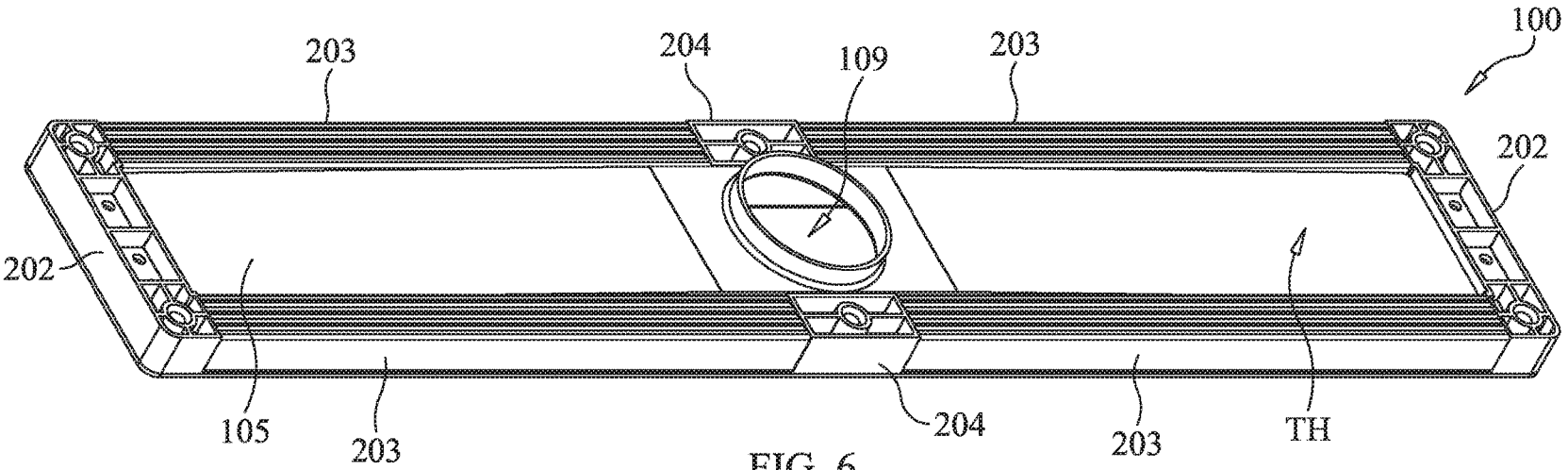
FIG. 6 is a bottom perspective view illustrating a drain channel and a support bracket assembly of a linear drain system, according to an exemplary embodiment of the present invention.
Figure 7:
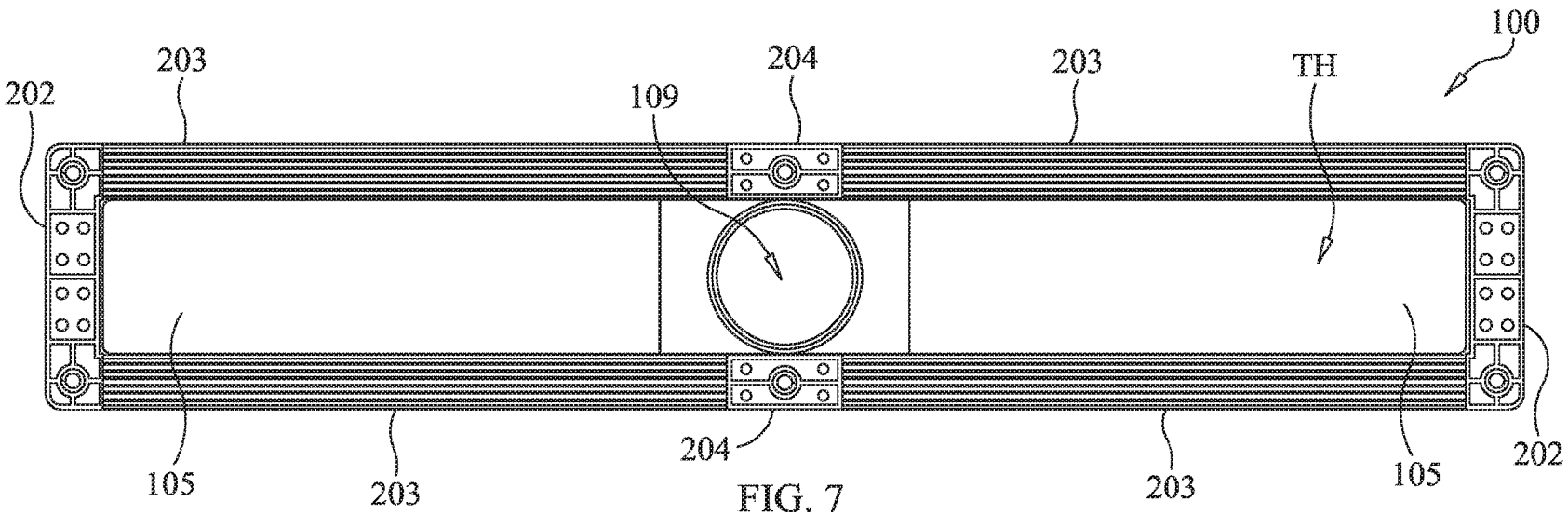
FIG. 7 is a bottom view illustrating a drain channel and a support bracket assembly of a linear drain system, according to an exemplary embodiment of the present invention.

FIG. 4 is a bottom perspective view illustrating a drain channel and a support bracket assembly of a linear drain system, according to an exemplary embodiment of the present invention. FIG. 5 is a bottom view illustrating a drain channel and a support bracket assembly of a linear drain system, according to an exemplary embodiment of the present invention. FIG. 6 is a bottom perspective view illustrating a drain channel and a support bracket assembly of a linear drain system, according to an exemplary embodiment of the present invention. FIG. 7 is a bottom view illustrating a drain channel and a support bracket assembly of a linear drain system, according to an exemplary embodiment of the present invention.

Referring to FIGS. 4-7, the L-shaped recess L is designed to receive the support bracket assembly 201 therein. For example, the support bracket assembly 201 is shaped and dimensioned to fit in the L-shaped recess L. When the support bracket assembly 201 is disposed in the L-shaped recess L, a bottom portion of the upper surface 102 of the drain channel 101 contacts an upper surface 205 of the support bracket assembly 201, and outer portions of the side surfaces 107 of the drain channel 101 contact inner side surfaces 206 of the support bracket assembly 201.

When fully installed, the support bracket assembly 201 is disposed in the L-shaped recess L on all sides of the drain channel 101, as shown in FIGS. 6 and 7, thus, entirely surrounding the perimeter of the drain channel 101. More specifically, the support bracket assembly 201 entirely surrounds the perimeter of the drain channel 101 in a location that is adjacent to the outer portions of the side surfaces 107 of the drain channel 101 and below the upper surface 102 of the drain channel 101 when the support bracket assembly 201 is disposed in the L-shaped recess L. For example, when fully assembled, the support bracket assembly 201 (which may be formed of a plurality of reconnectable bracket portions, as described below) fully inhabits the entirety of the L-shaped recess L that extends around the bottom of the drain channel 101, thus, entirely surrounding the perimeter of the drain channel 101 in a location that is adjacent to the outer portions of the side surfaces 107 of the drain channel 101 and below the upper surface 102 of the drain channel 101. As a result, the drain channel 101 rests on the support bracket assembly 201, and the support bracket assembly provides structural support for the drain channel 101.

According to exemplary embodiments of the present invention, a width of each portion of the support bracket assembly 201 is about equal to a width of the upper surface 102 of the drain channel 101 in the corresponding area in which the support bracket assembly 201 is disposed in the L-shaped recess L. As a result, the outer boundary of the support bracket assembly 201 does not extend beyond the outer boundary of the drain channel 101, and the support bracket assembly 201 is not visible in a plan view when it is disposed below the upper surface 102 of the drain channel 101 in the L-shaped recess L.

A drain channel of a linear drain system in a comparative example that does not include the support bracket assembly 201 is typically installed in a floor by creating a mortar bed (also referred to as a cement bed or a mud bed) that extends the length of the drain channel, and by backfilling the underside of the drain channel. The mortar bed is used to level the linear drain, and to provide support for the linear drain. However, installation utilizing the mortar bed can be difficult and time consuming. For example, difficulty often arises in regards to leveling the drain channel such that it is even with the floor during installation, and such that it remains even within the floor after the mortar bed dries. In addition, the mortar bed may leave behind debris that must be cleaned after installation.

In contrast, according to exemplary embodiments of the present invention, the support bracket assembly 201 is used to level the drain channel 101 and provide structural support for the drain channel 101 without the use of a mortar bed. For example, according to exemplary embodiments of the present invention, rather than backfilling the underside of the drain channel 101 with mortar, the support bracket assembly 201 is set within the L-shaped recess L of the drain channel 101 and is used to level the drain channel 101 with the floor and provide structural support for the drain channel 101.

According to exemplary embodiments of the present invention, when the support bracket assembly 201 is disposed in the L-shaped recess L of the drain channel 101, the upper surface 102 of the drain channel 101 entirely covers the support bracket assembly 201 when viewed from a top plan view. For example, once installed, the support bracket assembly 201 is disposed below the upper surface 102 of the drain channel 101, and no portion of the support bracket assembly 201 is viewable by a person looking down at the installed drain channel 101. For example, in the top plan view show in FIG. 2, the support bracket assembly 201 may be disposed below the drain channel 101 and is not visible since the drain channel 101 entirely covers the support bracket assembly 201.

Figure 8:
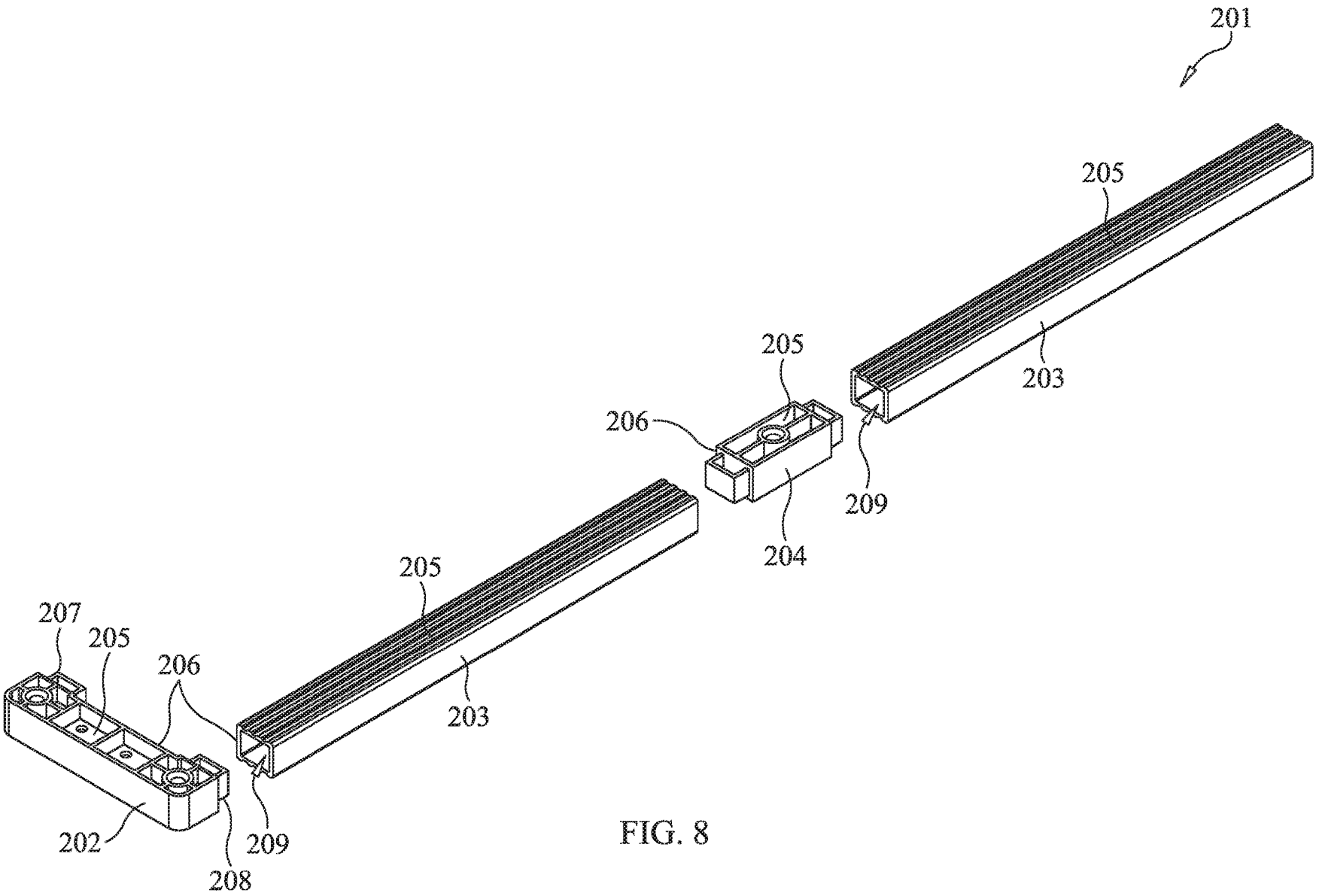
FIGS. 8-10 are perspective views illustrating components of a support bracket assembly of a linear drain system, according to an exemplary embodiment of the present invention.
Figure 9:
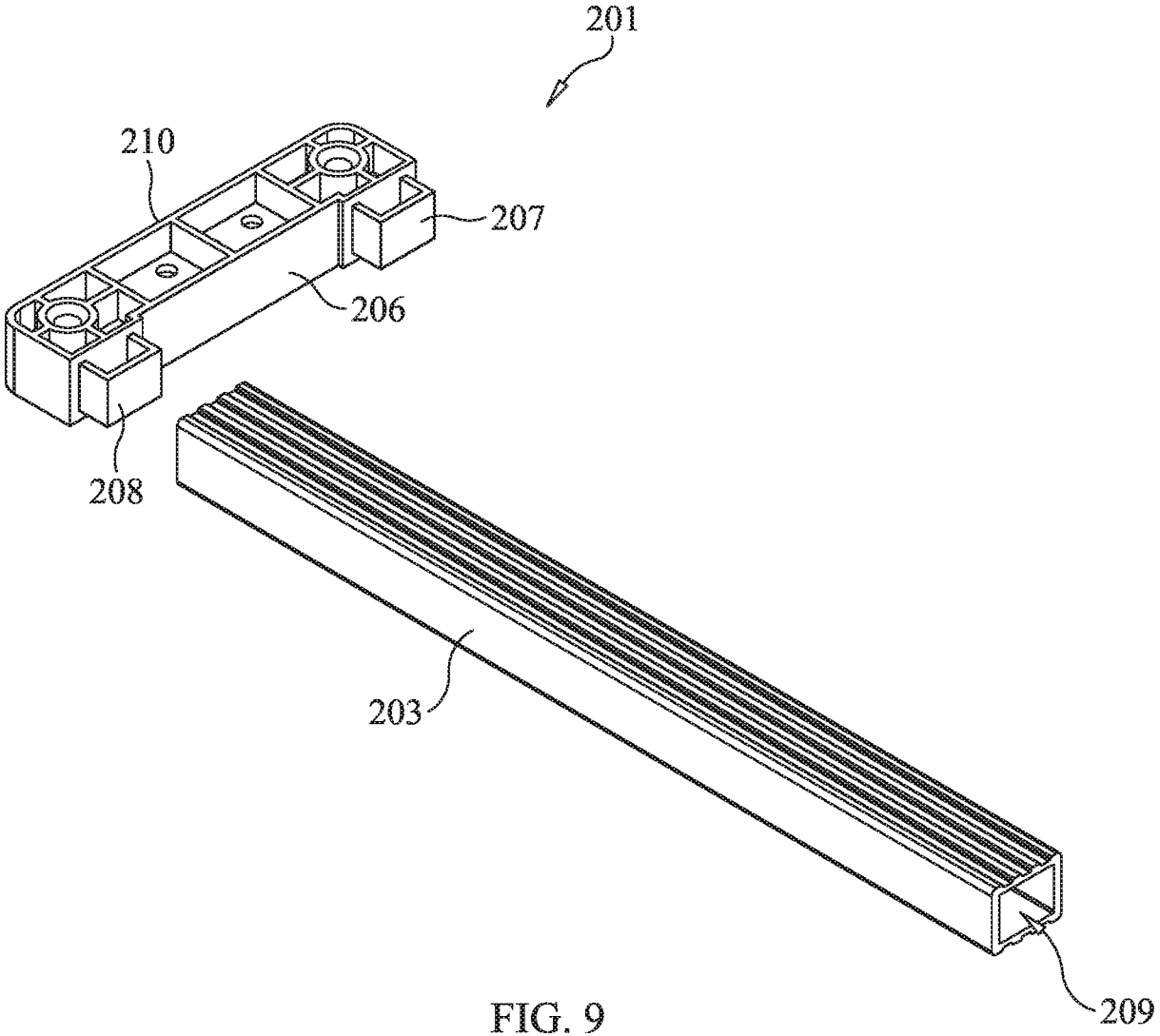
Figure 10:
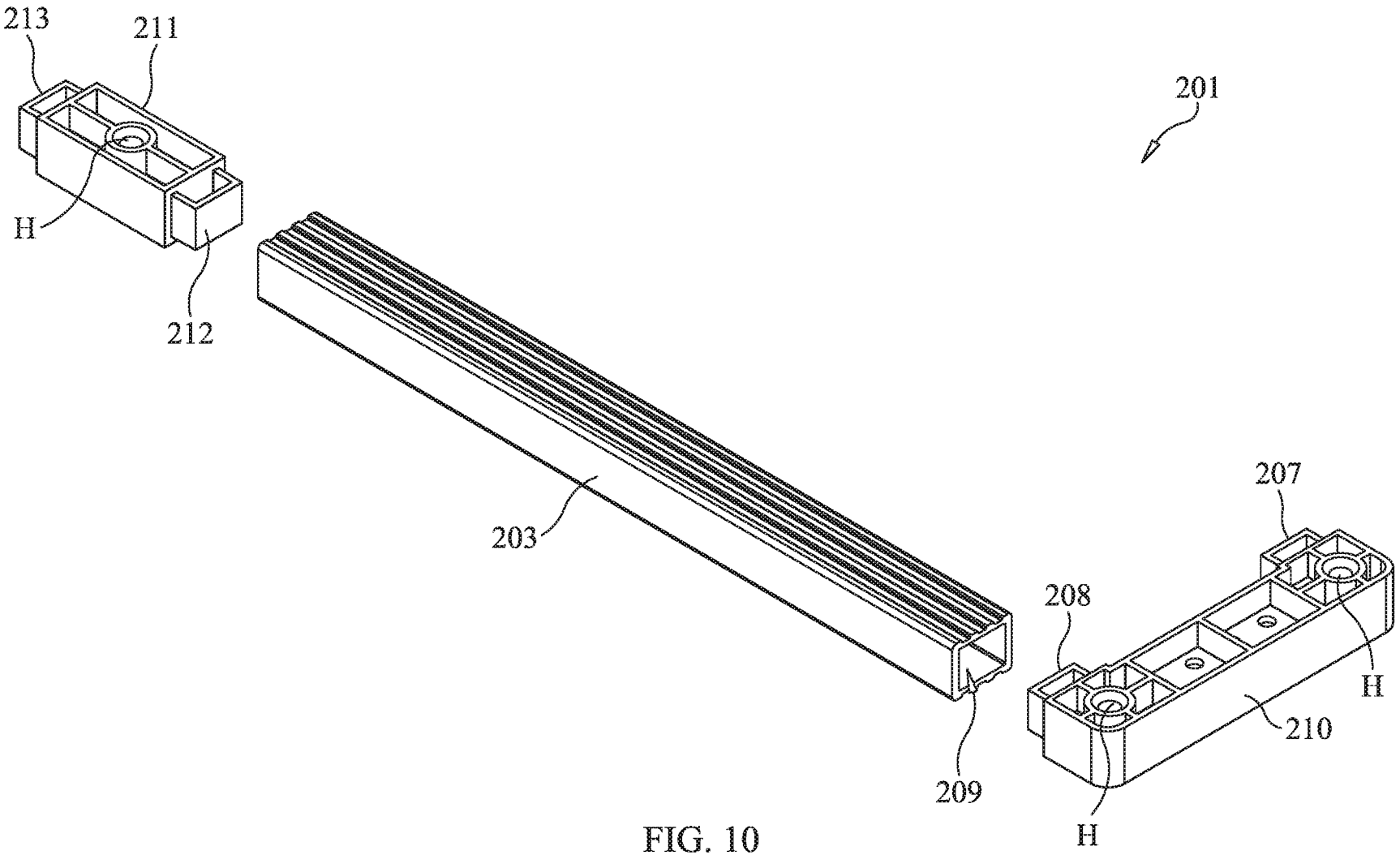

FIGS. 8-10 are perspective views illustrating components of a support bracket assembly of a linear drain system, according to an exemplary embodiment of the present invention.

According to exemplary embodiments of the present invention, the support bracket assembly 201 includes a plurality of reconnectable bracket portions configured to connect to each other and disconnect from each other. Utilization of a plurality of reconnectable bracket portions allows for the size of the support bracket assembly 201 to be modified to fit within the L-shaped recess L of different sized drain channels 101. For example, the size of the support bracket assembly 201 may be conveniently adjusted by removing and/or inserting bracket portions, permitting the support bracket assembly 201 to be utilized with a variety of different sized drain channels 101.

As shown in FIGS. 8-10, the reconnectable bracket portions may include three types of bracket portions: an end support bracket portion 202, an extrusion bracket portion 203, and a middle support bracket portion 204.

The end support bracket portion 202 is shaped and dimensioned to fit in the L-shaped recess L under the upper surface 102 of the drain channel 101 at an end region of the drain channel 101 (see FIGS. 4-7). The end support bracket portion 202 includes a main body portion 210 and two protrusions 207 and 208 extending from the main body portion 210 (see FIGS. 9 and 10). As shown in FIGS. 1-7, the drain channel 101 includes two short sides and two relatively longer sides connecting the two shorts sides to each other. The short sides correspond to the end region of the drain channel 101. The length and width of the main body portion 210 of the end support bracket portion 202 are about equal to the length and width of the upper surface 102 of the drain channel 101 in the end region, such that the upper surface 102 in the end region overlaps the main body portion 210 without extending beyond the main body portion 210, and without the main body portion 210 extending beyond the upper surface 102 in the end region. As a result, the end support bracket portion 202 fits beneath the end region of the drain channel 101 when disposed in the L-shaped recess L.

The protrusions 207 and 208 are shaped and dimensioned to fit within openings 209 of the extrusion bracket portion 203, resulting in the end support bracket portion 202 being connected to the extrusion bracket portion 203. For example, when inserted, the protrusions 207 and 208 snugly fit within the openings 209, resulting in the end support bracket portion 202 and the extrusion bracket portion 203 being connected to one another. For example, the end support bracket portion 202 may be connected to the extrusion bracket portion 203 by applying a sufficient amount of force such that the protrusions 207 and 208 are pushed into the openings 209. The size of the protrusions 207 and 208 is slightly smaller than the openings 209. For example, the size of the protrusions 207 and 208 is small enough to fit within the openings 209, but large enough to create a snug, frictional fit when pressed against the sides of the openings 209 to connect the end support bracket portion 202 and the extrusion bracket portion 203 to each other. The end support bracket portion 202 may be separated from the extrusion bracket portion 203 by applying a sufficient amount of force in an opposite direction such that the protrusions 207 and 208 are pulled out of the openings 209. As shown in FIGS. 8-10, the width of the two protrusions 207 and 208 is smaller than the width of the main body portion 210 of the end support bracket portion 202 from which they extend.

The extrusion bracket portion 203 is shaped and dimensioned to fit in the L-shaped recess L under the upper surface 102 of the drain channel 101 at side regions of the drain channel 101 (see FIGS. 4-7). For example, as shown in FIGS. 1-7, the drain channel 101 includes two short sides and two relatively longer sides connecting the two shorts sides to each other. The relatively longer sides correspond to the side regions of the drain channel 101. The width of the extrusion bracket portion 203 is about equal to the width of the upper surface 102 of the drain channel 101 in the side regions. As a result, the extrusion bracket portion 203 fits beneath the side regions of the drain channel 101 when disposed in the L-shaped recess L such that the upper surface 102 in the side regions overlaps the extrusion bracket portion 203 without extending beyond the extrusions bracket portion 203, and without the extrusion bracket portion 203 extending beyond the upper surface 102 in the side regions. As a result, the extrusion bracket portion 203 fits beneath the side regions of the drain channel 101 when disposed in the L-shaped recess L. Unlike the end support bracket portion 202, which may be described as having a right-angle C-shape formed by the main body portion 210 and the two protrusions 207 and 208, which extend in a second direction crossing a first direction in which the main body portion 210 extends, the extrusion bracket portion 203 may be described as a straight-line structure extending only in a single direction.

In an exemplary embodiment, the length of the extrusion bracket portion 203 is about equal to the length of the upper surface 102 of the drain channel 101 in the side regions. In this exemplary embodiment, a single extrusion bracket portion 203 may extend the entire length of each of the side regions. As a result, when the reconnectable bracket portions of the support bracket assembly 201 are fully connected to one another such that the support bracket assembly 201 forms a through hole TH and such that the support bracket assembly 201 entirely surrounds the perimeter of the drain channel 101, the bracket includes a total of four pieces: two end support bracket portions 202 respectively disposed in the L-shaped recess L in opposite end regions of the drain channel 101, and two extrusion bracket portions 203 respectively disposed in the L-shaped recess L in opposite side regions of the drain channel 101. Each extrusion bracket portion 203 includes two openings disposed on opposite ends of the extrusion bracket portion 203. One of these openings receives a protrusion 207/208 of one end support bracket portion 202 disposed at one end region of the drain channel 101, and the other one of these openings receives a protrusion 207/208 of the other one of the end support bracket portions 202 disposed at the other end region of the drain channel 101.

In another exemplary embodiment, the length of the extrusion bracket portion 203 is not equal to the length of the upper surface 102 of the drain channel 101 in the side regions, as shown in FIGS. 4-7. In this exemplary embodiment, a single extrusion bracket portion 203 does not extend the entire length of the side regions. Rather, a plurality of extrusion bracket portions 203 are connected to one another such that, together, they extend the entire length of the side regions (see FIGS. 4-7). As a result, the length of the support bracket assembly 201 may be modified such that the support bracket assembly 201 fits different drain channels 101 having different lengths.

Although the exemplary embodiments shown in FIGS. 6 and 7 illustrate two extrusion bracket portions 203 and one middle support bracket portion 204 respectively disposed in the two side regions of the drain channel 101, exemplary embodiments of the present invention are not limited thereto. For example, in exemplary embodiments, three or more extrusion bracket portions 203 and two more middle support bracket portions 204 may be respectively disposed in the two side regions of the drain channel 101 to accommodate a drain channel 101 having a longer length.

The middle support bracket portion 204 is used to connect a plurality of extrusion bracket portions 203 to one another. The middle support bracket portion 204 includes a main body portion 211 and two protrusions 212 and 213 extending from the main body portion 211 (see FIGS. 8 and 9). The main body portion 211 has the same width and height as the extrusion bracket portion 203. Thus, when the middle support bracket portion 204 and the extrusion bracket portion 203 are connected to each other, they form a continuous surface onto which the bottom portion of the upper surface 102 of the drain channel 101 rests upon. The two protrusions 212 and 213 are the same size and shape as the protrusions 207 and 208 of the end support bracket portion 202.

Similar to the protrusions 207 and 208 of the end support bracket portion 202, the protrusions 212 and 213 of the middle support bracket portion 204 are shaped and dimensioned to fit within the openings 209 of the extrusion bracket portion 203, resulting in the middle support bracket portion 204 being connected to the extrusion bracket portion 203. For example, when inserted, the protrusions 212 and 213 snugly fit within the openings 209, resulting in the middle support bracket portion 204 and the extrusion bracket portion 203 being connected to one another. For example, the middle support bracket portion 204 may be connected to the extrusion bracket portion 203 by applying a sufficient amount of force such that the protrusions 212 and 213 are pushed into the openings 209. The size of the protrusions 212 and 213 is the same as the protrusions 207 and 208, and thus, is slightly smaller than the openings 209. For example, the size of the protrusions 212 and 213 is small enough to fit within the openings 209, but large enough to create a snug, frictional fit when pressed against the sides of the openings 209 to connect the middle support bracket portion 204 and the extrusion bracket portion 203 to each other. The middle support bracket portion 204 may be separated from the extrusion bracket portion 203 by applying a sufficient amount of force in an opposite direction such that the protrusions 212 and 213 are pulled out of the openings 209. As shown in FIGS. 8-10, the width of the two protrusions 212 and 213 is smaller than the width of the main body portion 211 of the middle support bracket portion 204 from which they extend.

A single middle support bracket portion 204 connects two extrusion bracket portions 203 to each other. A plurality of middle support bracket portions 204 may be utilized to connect a plurality of extrusion bracket portions 203 to one another. For example, multiple extrusion bracket portions 203 may be connected to one another via a middle support bracket portion(s) 204 to span the length of an entire side region of the drain channel 101.

According to exemplary embodiments of the present invention, when the support bracket assembly 201 is fully formed (e.g., when all reconnectable bracket portions are fully connected to one another to fully inhabit the L-shaped recess L of the drain channel 101), the support bracket assembly 201 forms a rectangular through hole TH (see FIGS. 6 and 7). The size of the rectangular through hole TH corresponds to the size of the well region 108 formed by the inner portions of the side surfaces 107 of the drain channel 101 and by the lower surface 105 of the drain channel 101. The rectangular through hole TH is further sized to correspond to the L-shaped recess L of the drain channel 101. When the support bracket assembly 201 is disposed in the L-shaped recess L of the drain channel 101, the well region 108 of the drain channel 101 is disposed in the through hole TH (see FIGS. 6 and 7).

As shown in FIGS. 8-10, the width of the main body portion 210 of the end support bracket portion 202, the width of the extrusion bracket portion 203, and the width of the main body portion 211 of the middle support bracket portion 204 are substantially the same as one another. Similarly, the height of the main body portion 210 of the end support bracket portion 202, the height of the extrusion bracket portion 203, and the height of the main body portion 211 of the middle support bracket portion 204 are substantially the same as one another. As a result, when the end support bracket portions 202, the extrusion bracket portion(s) 203, and the middle support bracket portion(s) 204 are connected to one another to form a rectangular through hole TH that surrounds the perimeter of the drain channel 101, the drain channel 101 rests evenly on the bracket portions.

As shown in FIG. 10, according to exemplary embodiments of the present invention, the end support bracket portion 202 and the middle support bracket portion 204 include holes H. The holes are utilized to attach the support bracket assembly 201 to the floor that the linear drain channel 101 is being installed into. For example, wood screws, concrete screws, etc. may be driven through the holes H into the floor to attach the support bracket assembly 201 to the floor.

According to an exemplary embodiment of the present invention, a method of installing the linear drain system 100 includes the following steps. The reconnectable portions of the support bracket assembly 201 are connected to one another to form an opening corresponding to the size of the drain channel 101 being installed into a floor. For example, the protrusions and openings described above are utilized to connect two end support bracket portions 202 to extrusion bracket portions 203, and extrusion bracket portions 203 to a middle support bracket portion(s) 204 (if necessary based on the size of the drain channel 101) to form the through hole TH. In an exemplary embodiment, the reconnectable bracket portions forming the support bracket assembly 201 are fully connected to one another before the holes H are utilized to attach the support bracket assembly 201 to the floor. Alternatively, some of the reconnectable bracket portions may be attached to the floor via the holes H before all of the reconnectable bracket portions are connected to one another. The well region 108 of the drain channel 101 is placed in the through hole TH of the support bracket assembly 201. Thus, the support bracket assembly 201 levels the drain channel 101, and provides support for the drain channel 101, without the need for creating and using a mortar bed. That is, according to exemplary embodiments of the present invention, the drain channel 101 is installed in a floor using the support bracket assembly 201 without the use of a mortar/cement/mud bed (e.g., the support bracket assembly 201 is used to support and level the drain channel 101 instead of a mortar/cement/mud bed). As a result, the efficiency and convenience with relation to installation of a linear drain are improved according to exemplary embodiments of the present invention.

The actual sizes and dimensions of the bracket portions of the support bracket assembly 201 may vary, as long as the respective relationships between the sizes and dimensions of the bracket portions relative to one another and relative to the drain channel 101 described above are maintained. Similarly, the actual size and dimensions of the drain channel 101 and the portions thereof may vary. For example, the exemplary embodiments of the present invention described herein may be applied to a linear drain of any size.

Exemplary embodiments of the present invention may be utilized with a variety of linear drain systems. For example, exemplary embodiments may be utilized with a linear drain system having a wedge wire system, a perforated drain system, or a tile insert system. However, exemplary embodiments are not limited thereto.

Having described exemplary embodiments for a linear drain system including a drain channel and a support bracket assembly, it is noted that modifications and variations can be made by persons skilled in the art in light of the above teachings. It is therefore to be understood that changes may be made in exemplary embodiments of the invention, which are within the scope and spirit of the invention as defined by the appended claims. Having thus described the invention with the details and particularity required by the patent laws, what is claimed and desired protected by Letters Patent is set forth in the appended claims.

What is claimed is:

1. A linear drain system, comprising:

a drain channel, comprising:

an upper surface, a lower surface, and a plurality of side surfaces connecting the upper surface and the lower surface;

a drain hole disposed in the lower surface; and an L-shaped recess formed on an underside of the drain channel by the upper surface, the lower surface, and the side surfaces; and a support bracket assembly shaped and dimensioned to fit in the L-shaped recess, wherein, when the support bracket assembly is disposed in the L-shaped recess, a bottom portion of the upper surface of the drain channel contacts an upper surface of the support bracket assembly, and outer portions of the side surfaces of the drain channel contact inner side surfaces of the support bracket assembly.

2. The linear drain system of claim 1, wherein the support bracket assembly entirely surrounds a perimeter of the drain channel in a location adjacent to the outer portions of the side surfaces of the drain channel and below the upper surface of the drain channel when the support bracket assembly is disposed in the L-shaped recess.

3. The linear drain system of claim 1, wherein the upper surface of the drain channel entirely covers the support bracket assembly in a top plan view when the support bracket assembly is disposed in the L-shaped recess.

4. The linear drain system of claim 1, wherein the support bracket assembly comprises a plurality of reconnectable bracket portions configured to connect to one another and disconnect from one another.

5. The linear drain system of claim 4, wherein the reconnectable bracket portions comprise:

an end support bracket portion shaped and dimensioned to fit in the L-shaped recess at an end region of the drain channel;

an extrusion bracket portion shaped and dimensioned to fit in the L-shaped recess at a side region of the drain channel, and configured to connect to the end support bracket portion; and a middle support bracket portion shaped and dimensioned to fit in the L-shaped recess at the side region of the drain channel, and configured to connect the extrusion bracket portion to another extrusion bracket portion disposed in the side region of the drain channel.

6. The linear drain system of claim 5, wherein the drain channel comprises a first side and a second side opposing each other, and a third side and a fourth side opposing each other and connected between the first and second sides, wherein the first side and the second side have a first length, and the third side and the fourth side have a second length greater than the first length, wherein the end region of the drain channel corresponds to one of the first and second sides, and the side region of the drain channel corresponds to one of the third and fourth sides.

7. The linear drain system of claim 6, wherein the end support bracket portion comprises a first main body portion extending in a first direction, a first protrusion extending from the first main body portion in a second direction crossing the first direction, and a second protrusion extending from the first main body portion in the second direction, wherein the extrusion bracket portion comprises a first opening at a first end, and a second opening at a second end opposing the first end, wherein the middle support bracket portion comprises a second main body portion extending in a third direction, a third protrusion extending from a first end of the middle support bracket portion in the third direction, and a fourth protrusion extending from a second end of the middle support bracket portion in the third direction, wherein the second end of the middle support bracket portion opposes the first end of the middle support bracket portion.

8. The linear drain system of claim 7, wherein a width of the first main body portion is about equal to a width of the upper surface of the drain channel in the end region, a width of the extrusion bracket portion is about equal to a width of the upper surface of the drain channel in the side region, and a width of the second main body portion is about equal to the width of the upper surface of the drain channel in the side region.

9. A linear drain system, comprising:

a drain channel, comprising:

an upper surface comprising a plurality of inner edges and a plurality of outer edges extended from the inner edges;

a lower surface comprising a drain hole and a plurality of outer edges; and a plurality of side surfaces connecting the outer edges of the lower surface to the inner edges of the upper surface, wherein a well region is formed by inner portions of the side surfaces and by the lower surface, and an L-shaped recess is formed by outer portions of the side surfaces and by a bottom portion of the upper surface; and a support bracket assembly shaped and dimensioned to fit in the L-shaped recess, wherein, when the support bracket assembly is disposed in the L-shaped recess, the bottom portion of the upper surface of the drain channel contacts an upper surface of the support bracket assembly, and the outer portions of the side surfaces of the drain channel contact inner side surfaces of the support bracket assembly.

10. The linear drain system of claim 9, wherein the support bracket assembly entirely surrounds a perimeter of the drain channel in a location adjacent to the outer portions of the side surfaces of the drain channel and below the upper surface of the drain channel when the support bracket assembly is disposed in the L-shaped recess.

11. The linear drain system of claim 9, wherein the upper surface of the drain channel entirely covers the support bracket assembly in a top plan view when the support bracket assembly is disposed in the L-shaped recess.

12. The linear drain system of claim 9, wherein a distance between opposing outer edges of the upper surface of the drain channel is greater than a distance between opposing outer edges of the lower surface of the drain channel, and the distance between the opposing outer edges of the lower surface of the drain channel is about equal to a distance between opposing inner edges of the upper surface of the drain channel.

13. The linear drain system of claim 9, wherein the support bracket assembly comprises a rectangular through hole, and when the support bracket assembly is disposed in the L-shaped recess, the well region is disposed in the through hole.

14. The linear drain system of claim 9, wherein the support bracket assembly comprises a plurality of reconnectable bracket portions configured to connect to one another and disconnect from one another.

15. The linear drain system of claim 14, wherein the reconnectable bracket portions comprise:

an end support bracket portion shaped and dimensioned to fit in the L-shaped recess at an end region of the drain channel;

an extrusion bracket portion shaped and dimensioned to fit in the L-shaped recess at a side region of the drain channel, and configured to connect to the end support bracket portion; and a middle support bracket portion shaped and dimensioned to fit in the L-shaped recess at the side region of the drain channel, and configured to connect the extrusion bracket portion to another extrusion bracket portion disposed in the side region of the drain channel.

16. The linear drain system of claim 15, wherein the drain channel comprises a first side and a second side opposing each other, and a third side and a fourth side opposing each other and connected between the first and second sides, wherein the first side and the second side have a first length, and the third side and the fourth side have a second length greater than the first length, wherein the end region of the drain channel corresponds to one of the first and second sides, and the side region of the drain channel corresponds to one of the third and fourth sides.

17. The linear drain system of claim 16, wherein the end support bracket portion comprises a first main body portion extending in a first direction, a first protrusion extending from the first main body portion in a second direction crossing the first direction, and a second protrusion extending from the first main body portion in the second direction, wherein the extrusion bracket portion comprises a first opening at a first end, and a second opening at a second end opposing the first end, wherein the middle support bracket portion comprises a second main body portion extending in a third direction, a third protrusion extending from a first end of the middle support bracket portion in the third direction, and a fourth protrusion extending from a second end of the middle support bracket portion in the third direction, wherein the second end of the middle support bracket portion opposes the first end of the middle support bracket portion.

18. The linear drain system of claim 17, wherein a width of the first main body portion is about equal to a width of the upper surface of the drain channel in the end region, a width of the extrusion bracket portion is about equal to a width of the upper surface of the drain channel in the side region, and a width of the second main body portion is about equal to the width of the upper surface of the drain channel in the side region.

19. The linear drain system of claim 18, wherein a height of the first main body portion, a height of the extrusion bracket portion, and a height of the second main body portion are about equal to one another.

20. The linear drain system of claim 14, wherein the reconnectable bracket portions comprise:

a first end support bracket portion shaped and dimensioned to fit in the L-shaped recess at a first end region of the drain channel, wherein the first end support bracket portion comprises a first main body portion, a first protrusion extending from the first main body portion, and a second protrusion extending from the first main body portion;

a second end support bracket portion shaped and dimensioned to fit in the L-shaped recess at a second end region of the drain channel that opposes the first end region, wherein the second end support bracket portion comprises a second main body portion, a third protrusion extending from the second main body portion, and a fourth protrusion extending from the second main body portion;

a first middle support bracket portion shaped and dimensioned to fit in the L-shaped recess at a first side region of the drain channel, wherein the first middle support bracket portion comprises a third main body portion, a fifth protrusion extending from the third main body portion, and a sixth protrusion extending from the third main body portion;

a second middle support bracket portion shaped and dimensioned to fit in the L-shaped recess at a second side region of the drain channel that opposes the first side region, wherein the second middle support bracket portion comprises a fourth main body portion, a seventh protrusion extending from the fourth main body portion, and an eighth protrusion extending from the fourth main body portion;

a first extrusion bracket portion shaped and dimensioned to fit in the L-shaped recess at the first side region of the drain channel, wherein the first extrusion bracket portion comprises a first opening at a first end of the first extrusion bracket portion, and a second opening at a second end of the first extrusion bracket portion, wherein the first extrusion bracket portion is configured to connect to the first end support bracket portion via the first opening receiving the first protrusion, and the first extrusion bracket portion is configured to connect to the first middle support bracket portion via the second opening receiving the fifth protrusion;

a second extrusion bracket portion shaped and dimensioned to fit in the L-shaped recess at the first side region of the drain channel, wherein the second extrusion bracket portion comprises a third opening at a first end of the first extrusion bracket portion, and a fourth opening at a second end of the second extrusion bracket portion, wherein the second extrusion bracket portion is configured to connect to the second end support bracket portion via the third opening receiving the third protrusion, and the second extrusion bracket portion is configured to connect to the first middle support bracket portion via the fourth opening receiving the sixth protrusion;

a third extrusion bracket portion shaped and dimensioned to fit in the L-shaped recess at the second side region of the drain channel, wherein the third extrusion bracket portion comprises a fifth opening at a first end of the third extrusion bracket portion, and a sixth opening at a second end of the third extrusion bracket portion, wherein the third extrusion bracket portion is configured to connect to the first end support bracket portion via the fifth opening receiving the second protrusion, and the third extrusion bracket portion is configured to connect to the second middle support bracket portion via the sixth opening receiving the seventh protrusion; and a fourth extrusion bracket portion shaped and dimensioned to fit in the L-shaped recess at the second side region of the drain channel, wherein the fourth extrusion bracket portion comprises a seventh opening at a first end of the fourth extrusion bracket portion, and an eighth opening at a second end of the fourth extrusion bracket portion, wherein the fourth extrusion bracket portion is configured to connect to the second end support bracket portion via the eighth opening receiving the fourth protrusion, and the fourth extrusion bracket portion is configured to connect to the second middle support bracket portion via the seventh opening receiving the eighth protrusion.

* * * * *